US007306718B2

(12) United States Patent
Gardenier

(10) Patent No.: US 7,306,718 B2
(45) Date of Patent: Dec. 11, 2007

(54) SKIMMER WITH FLEXIBLE WEIR GATE FOR SPAS AND POOLS

(75) Inventor: W. John Gardenier, Wallingford, CT (US)

(73) Assignee: ThermoSpas, Inc., Wallingford, CT (US)

( * ) Notice: Subject to any disclaimer, the term of this patent is extended or adjusted under 35 U.S.C. 154(b) by 574 days.

(21) Appl. No.: 10/992,449

(22) Filed: Nov. 18, 2004

(65) Prior Publication Data

US 2006/0102539 A1 May 18, 2006

(51) Int. Cl.
*E04H 4/12* (2006.01)

(52) U.S. Cl. ..... 210/167.1; 210/167.12; 210/416.2; 4/507; 4/509

(58) Field of Classification Search ..... 210/167.01, 210/167.1, 167.12, 167.15, 167.18, 167.19, 210/416.2; 4/507, 509
See application file for complete search history.

(56) References Cited

U.S. PATENT DOCUMENTS

| | | | | |
|---|---|---|---|---|
| 3,939,505 A | | 2/1976 | Gross | 4/172.17 |
| 4,574,405 A | * | 3/1986 | Tams | 4/508 |
| 4,637,873 A | | 1/1987 | DeSousa et al. | 210/169 |
| 5,392,471 A | * | 2/1995 | Vos | 4/507 |
| RE35,410 E | | 12/1996 | Adcock et al. | 4/541.3 |
| 5,642,534 A | | 7/1997 | Sanchez et al. | 4/507 |
| 5,948,245 A | | 9/1999 | Hodak | 210/169 |
| 5,989,419 A | | 11/1999 | Dudley et al. | 210/169 |
| 6,393,628 B1 | * | 5/2002 | Kellogg | 4/490 |
| 6,453,483 B1 | | 9/2002 | Jacuzzi et al. | 4/507 |
| 6,592,341 B1 | | 7/2003 | Olney | 417/313 |
| 7,011,747 B2 | * | 3/2006 | Hodak | 210/167.12 |

FOREIGN PATENT DOCUMENTS

DE 19602015 * 7/1997

* cited by examiner

*Primary Examiner*—Fred G. Prince
(74) *Attorney, Agent, or Firm*—Gordon & Jacobson, P.C.

(57) ABSTRACT

A pool/spa skimmer includes a housing and a face plate opening into the housing. The face plate is dimensioned to allow water to flow in a vertical column between it and the housing. In one embodiment, a flexible weir gate is coupled to the face plate and flexes under draw of water by a pump to allow flow of water into the skimmer. The interior of the housing has a curved wall so that when a column of water passes the face plate into the housing, a whirlpool effect is realized.

13 Claims, 3 Drawing Sheets

SKIMMER WITH FLEXIBLE WEIR GATE FOR SPAS AND POOLS

BACKGROUND OF THE INVENTION

1. Field of the Invention

This invention relates broadly to water filtration. More particularly, this invention relates to a skimmer having a replaceable cartridge filter.

2. State of the Art

Conventional skimmers for pools and spas include a weir which is hinged at the bottom and provided with a float at the top. Behind the weir is a sump in which a filter or a basket is placed. A filter pump is coupled to the sump and draws water from the pool or spa over the weir and into the sump through the filter or basket. The floating weir assures that the pool/spa water is drawn from the surface into the sump. This causes floating waste to be drawn across the surface of the water and into the skimmer.

In skimmers which have baskets rather than filter cartridges, the owner can see waste accumulate in the basket and will know to empty the basket periodically. Skimmers which utilize replaceable filter cartridges are different. A good example of such a skimmer is shown in U.S. Pat. No. 4,637,873 issued Jan. 20, 1987 to DeSousa et al. A cylindrical filter cartridge is disposed vertically in the skimmer housing below the weir. It is difficult or impossible to determine visually whether the filter needs to be replaced. In addition, because of the way the filter cartridge is disposed in the skimmer housing, it is possible that the outer surface will become unevenly coated with waste, thereby requiring replacement more frequently than if the filter were evenly coated.

SUMMARY OF THE INVENTION

It is therefore an object of the invention to provide a skimmer and filter for a pool or spa.

It is another object of the invention to provide a skimmer which uses replaceable filter cartridges.

It is a further object of the invention to provide a skimmer which provides a visual indication of when a filter cartridge needs to be replaced.

It is also an object of the invention to provide a skimmer which makes more efficient use of filter cartridges.

In accord with these objects, which will be discussed in detail below, the skimmer according to the invention includes a housing, a skimmer face plate coupled to the housing, and a flexible weir gate coupled to the face plate. When the filter pump is activated, the weir gate flexes to allow water to flow both over the top of the face plate and in a vertical column between the face plate and the housing. The interior of the housing has a curved wall so that when a column of water passes the weir gate and is pulled down into the housing, a whirlpool effect is realized. A vertical filter cartridge is mounted on a rotational bearing in the housing so that it can spin about its axis. The inlet of a filter pump is coupled to the cartridge via the bearing. The inlet of the pump is also coupled to a below the surface water inlet via a check valve. When the filter is clean, water is drawn through it by the pump and the filter spins about its axis due to the whirlpool effect of the column of water. When the filter reaches a threshold dirt covering, water is no longer drawn through it and the draw through the housing is decreased, causing the check valve to open to allow more water to the pump. As the flow rate through the housing decreases, the rate of rotation of the cartridge decreases, thus giving a visual indication that it needs to be replaced.

Spinning the cartridge during operation also causes it to be more evenly coated with dirt. This makes more efficient use of the cartridge.

According to an illustrated embodiment, the weir gate flexes about a central mount and two filter cartridges are arranged side by side. When clean, the filter cartridges spin in opposite directions.

Additional objects and advantages of the invention will become apparent to those skilled in the art upon reference to the detailed description taken in conjunction with the provided figures.

BRIEF DESCRIPTION OF THE DRAWINGS

FIG. 3 is a schematic top view of a skimmer assembly according to the invention with the pump on; and FIG. 4 is a schematic side elevation view of the skimmer assembly with the pump on.

DETAILED DESCRIPTION OF THE PREFERRED EMBODIMENTS

Figure 1:
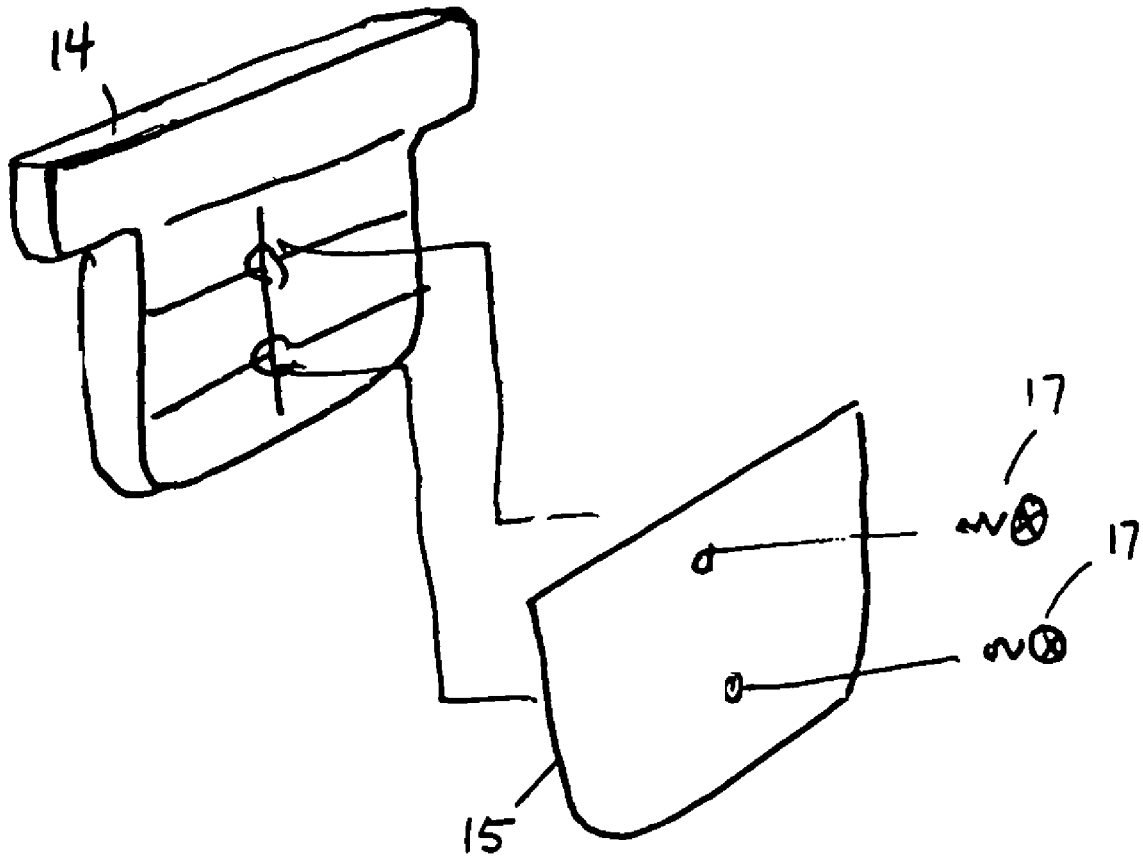
FIG. 1 is an exploded perspective view of a portion of a skimmer assembly according to the invention.

Referring now to FIGS. 1-4, a skimmer 10 according to the invention includes a first housing 12 and a skimmer face plate 14 opening into the housing. The face plate 14 is dimensioned to form lateral vertical gaps 16, 18 which allow water W to flow in vertical columns between the face plate 14 and the first housing 12, and a top gap 19 over which water W can flow. This is illustrated best in FIGS. 3 and 4. In addition, and as shown in FIGS. 1-4, the face plate 14 has a flexible weir gate 15 coupled to it by fasteners 17 which are centrally located to allow the edges of the gate 15 to flex. When water passes through the gaps 16, 18, 19 between the weir gate 14 and the first housing 12, the sides and top of the weir gate 15 flex. Flexion at the top allows water to be skimmed across the surface. Flexion at the sides allows water to enter the housing 12 in columns. When the pump is deactivated, the weir gate 15 reassumes its original shape and covers the gaps 16, 18, 19.

Figure 2:
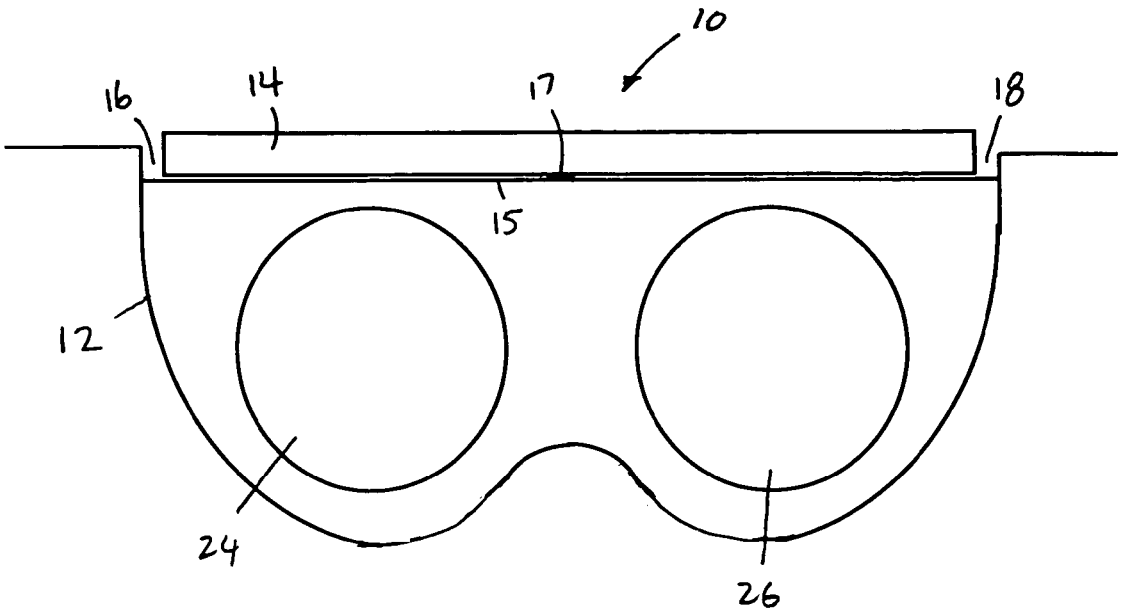
FIG. 2 is a schematic top view of a skimmer assembly according to the invention with the pump off.
Figure 3:
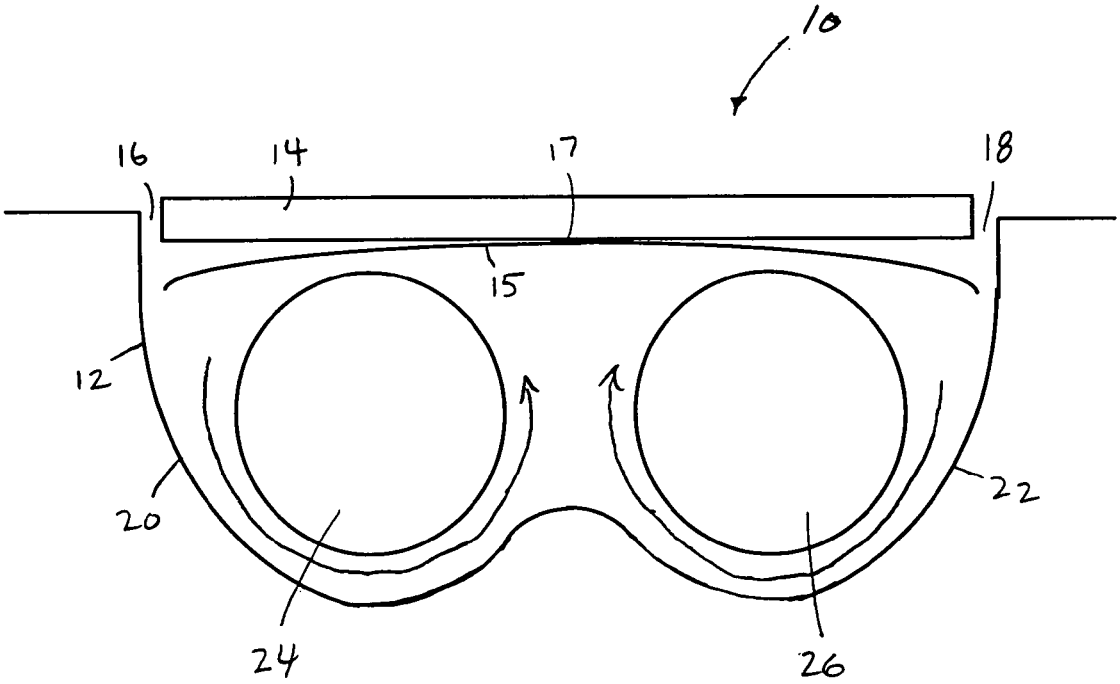
Figure 4:
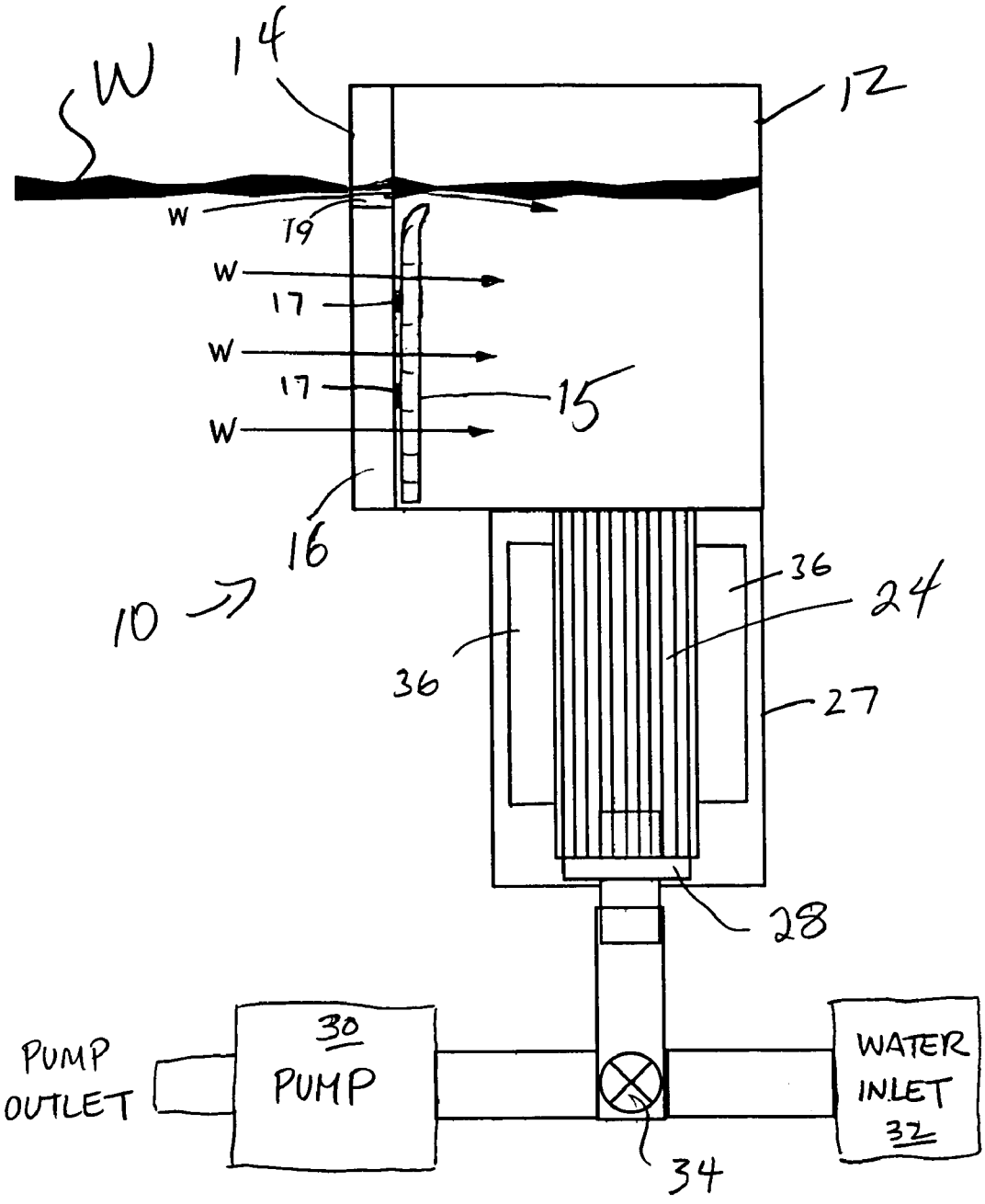

As seen best in FIGS. 2 and 3, the interior of the first housing 12 has a pair of curved walls 20, 22 each adjacent one of the gaps 16, 18. The curved walls are arranged so that when a column of water passes through the gaps 16, 18 between the face plate 14 and the first housing 12, and over the weir gate 15, a whirlpool effect is realized. This is illustrated by the circular arrows in FIG. 3. A pair of vertical filter cartridges 24, 26 are mounted beneath the face plate in a second housing 27 (shaped similar to the first housing 12) as shown in FIGS. 2-4. Each cartridge is mounted on a rotational bearing, one of which 28 is shown in relation to cartridge 24 in FIG. 4. The rotational bearings allow the filter cartridges to spin under the influence of the whirlpools as shown by the arrows in FIG. 3. Optionally, the filter cartridges may be provided with radially extending longitudinal fins 36 to aid in spinning the cartridge under the influence of the whirlpool. Although the drawing shows only two fins, three or four are preferred. Other rotational aids may also be provided to the filter cartridges, such as paddle wheel elements at one or both ends of the cartridges.

The inlet of a filter pump 30 is coupled to the cartridge 24 via the bearing 28 as shown in FIG. 4. The inlet of the pump is also coupled to a water inlet 32 via a check valve 34. The water inlet 32 is located below the surface of the water W. It will be appreciated that the outlet of the pump 30 returns filtered water back to the pool/spa. When the filter cartridges 24, 26 are clean, water is drawn through them by the pump 30 and the cartridges spin about their axes due to the whirlpool effect of the column of water. When a cartridge reaches a threshold dirt covering, water is no longer drawn through it and the check valve 34 opens to allow more water the pump 30. When water is no longer being drawn through a filter cartridge, it stops spinning, thus giving a visual indication that it needs to be replaced. Spinning the cartridges during operation also causes them to be more evenly coated with dirt. This makes more efficient use of the cartridge.

There have been described and illustrated herein several embodiments of a pool/spa skimmer. While particular embodiments of the invention have been described, it is not intended that the invention be limited thereto, as it is intended that the invention be as broad in scope as the art will allow and that the specification be read likewise. Thus, while the illustrated skimmer has two filter cartridges, it will be appreciated that a skimmer with a single cartridge could be constructed incorporating the features of the invention. In a single filter embodiment, the face plate would be configured to allow only a single column of water to enter the housing. Instead of a flexible weir gate, a spring biased hinged gate could be used. It will therefore be appreciated by those skilled in the art that yet other modifications could be made to the provided invention without deviating from its spirit and scope as claimed.

What is claimed is:

1. A pool/spa skimmer, comprising:

a housing having an opening exposed to pool/spa water, said housing being partially above the water level and partially below the water level;

a stationary face plate blocking entrance of water into said housing except for a horizontal gap and a vertical gap;

a flexible weir gate coupled to said face plate, said flexible weir gate covering said gaps; and a pump coupled to said housing, wherein when said pump is activated, said flexible weir gate flexes and allows water to enter through said gaps.

2. A pool/spa skimmer according to claim 1, wherein:

a whirlpool is formed in said housing by water entering through said vertical gap.

3. A pool/spa skimmer according to claim 1, wherein:

said housing has a curved wall adjacent said vertical gap.

4. A pool/spa skimmer according to claim 1, wherein:

said vertical gap is two spaced apart vertical gaps.

5. A pool/spa skimmer according to claim 4, wherein:

two whirlpools are formed in said housing by water entering through said vertical gaps.

6. A pool/spa skimmer according to claim 4, wherein:

said housing has two curved walls, each adjacent one of said vertical gaps.

7. A pool/spa skimmer according to claim 1, wherein:

said flexible weir gate flexes at both its upper and lateral edges.

8. A pool/spa skimmer, comprising:

a housing;

a first member fixed relative to said housing and defining a lateral vertical gap and an upper horizontal gap between said housing and said member;

a flexible second member coupled relative to said first member, said flexible second member covering said gaps; and a pump coupled to said housing, wherein when said pump is activated, said second member flexes and allows water to enter from the pool/spa through said gaps and into said housing.

9. A pool/spa skimmer, comprising:

a housing;

a first member fixed relative to said housing and defining at least one lateral vertical gap between said housing and said first member;

a second member coupled relative to said first member and covering said gaps; and a pump coupled to said housing, wherein when said pump is activated, said second member moves and allows water to enter from the pool/spa through said at least one lateral gap and into said housing.

10. A pool/spa skimmer according to claim 9, wherein:

said at least one lateral gap is two vertical gaps.

11. A pool/spa skimmer according to claim 10, wherein:

said first member is fixed relative to said housing to define an upper horizontal gap between said housing and said first member, and when said pump is activated said second member moves and allows water to enter from the pool/spa through said upper horizontal gap and into said housing.

12. A pool/spa skimmer according to claim 9, wherein:

said first member is fixed relative to said housing to define an upper horizontal gap between said housing and said first member, and when said pump is activated said second member moves and allows water to enter from the pool/spa through said upper horizontal gap and into said housing.

13. A pool/spa skimmer according to claim 9, wherein:

said second member is flexible, and when said pump is activated, said second member flexes to allow water to enter from the pool/spa through said at least one gap and into said housing.

* * * * *